US006428051B1

(12) United States Patent
Herrmann et al.

(10) Patent No.: US 6,428,051 B1
(45) Date of Patent: Aug. 6, 2002

(54) VALUE-BEARING DOCUMENT WITH WINDOW

(75) Inventors: Jürgen Herrmann, Alsbach; Werner Reinhart, Nürnberg, both of (DE)

(73) Assignee: Leonhard Kurz GmbH & Co., Furth (DE)

( * ) Notice: Subject to any disclaimer, the term of this patent is extended or adjusted under 35 U.S.C. 154(b) by 0 days.

(21) Appl. No.: 08/557,138

(22) PCT Filed: Oct. 6, 1994

(86) PCT No.: PCT/DE94/01185

§ 371 (c)(1),
(2), (4) Date: Nov. 16, 1995

(87) PCT Pub. No.: WO95/10420

PCT Pub. Date: Apr. 20, 1995

(30) Foreign Application Priority Data

Oct. 13, 1993 (DE) ..... 43 34 847

(51) Int. Cl.[7] ..... B42D 15/00

(52) U.S. Cl. ..... 283/107; 283/86; 283/91; 283/901; 428/916

(58) Field of Search ..... 283/107–111, 91, 283/93, 94, 57–59, 86, 901, 902, 904; 428/915, 916

(56) References Cited

U.S. PATENT DOCUMENTS

| | | | | | |
|---|---|---|---|---|---|
| 3,512,286 | A | * | 5/1970 | Siegel | 283/109 |
| 4,126,373 | A | * | 11/1978 | Moraw | 283/109 |
| 4,629,647 | A | * | 12/1986 | Sander | 428/915 |
| 4,943,093 | A | * | 7/1990 | Melling et al. | 283/901 |
| 4,984,824 | A | * | 1/1991 | Antes et al. | 283/91 |
| 5,248,544 | A | * | 9/1993 | Kahule | 283/94 |
| 5,310,222 | A | * | 5/1994 | Chatwin et al. | 283/86 |
| 5,513,019 | A | * | 4/1996 | Cueli | 283/86 |
| 5,516,153 | A | * | 5/1996 | Kahule | 283/901 |

FOREIGN PATENT DOCUMENTS

| | | | | |
|---|---|---|---|---|
| EP | 251253 | * | 1/1988 | 283/94 |
| GB | 1604463 | * | 12/1981 | 283/58 |
| GB | 2119312 | * | 11/1983 | 283/94 |
| WO | 8001520 | * | 7/1980 | 283/904 |

* cited by examiner

*Primary Examiner*—A. L. Wellington
(74) *Attorney, Agent, or Firm*—Hoffmann & Baron, LLP

(57) ABSTRACT

Proposed is a value-bearing document in which the carrier is provided with a window-like opening which is closed by a cover foil which is transparent at least in a region-wise manner, wherein in particular in the region of the window-like opening the cover foil can be provided with additional security features, for example diffraction structures.

19 Claims, 1 Drawing Sheet

VALUE-BEARING DOCUMENT WITH WINDOW

BACKGROUND OF THE INVENTION

1. Field of the Invention

Figure 1:
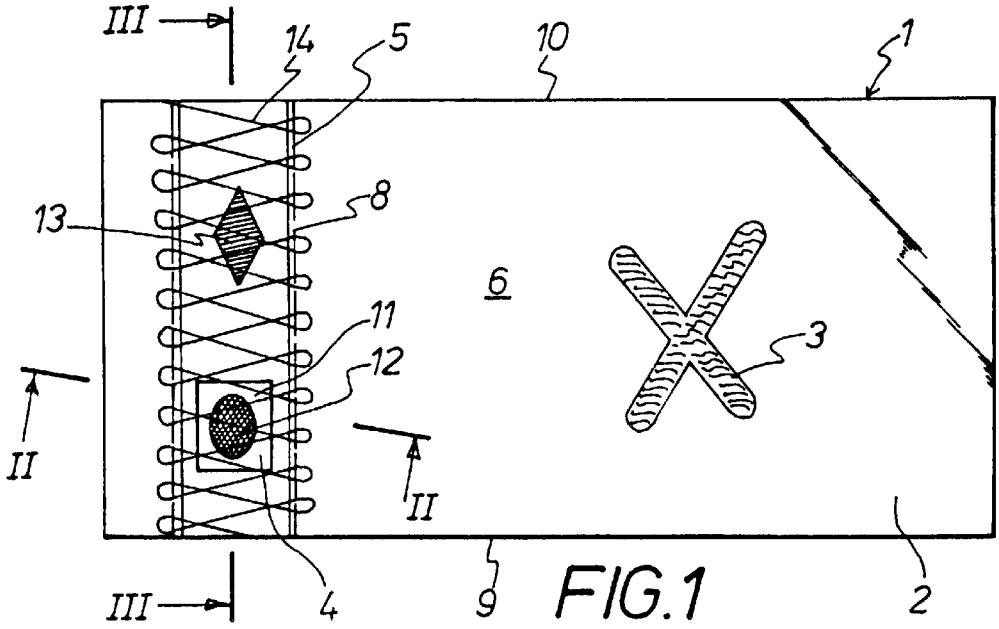

This invention relates to value-bearing documents, and more particularly, to value-bearing documents, such as for example, bank notes, cheques, traveler's cheques, share certificates, credit cards and identity cards.

2. Description of the Prior Art

Particularly having regard to the options afforded by modern color copiers and other reproducing systems, there is an urgent need for value-bearing documents to be provided with special security elements which make it difficult to produce a forgery using items of equipment of that kind. A large number of possible procedures have already been proposed for that purpose.

It is known for example for value-bearing documents such as value-bearing papers, cards, identity cards etc to be provided with security elements in the form of reflecting surfaces. Those reflecting surfaces are normally reproduced by a color copier as black surfaces. In this case however there is the possibility of subsequently applying a suitable, metallically shiny layer.

A further improvement in affording a safeguard against forgery is achieved when security elements in the form of structures which have an optical-diffraction or optical-refraction effect, so-called diffraction structures, for example holograms, so-called pixelgrams etc are used. However those security elements are comparatively expensive in terms of production.

It is also already known for security elements for value-bearing documents to be so designed that they are suitable in particular for viewing in a transillumination mode. For example AU-patent specification No 488 652 describes security documents which comprise a plurality of interconnected plastic webs, wherein at least one optically variable security element is arranged between those webs and a transparent window is provided in at least one of the cover webs in the region of the security element so that the security element can be viewed through the window. For applying the security elements, in accordance with the state of the art for example the procedure is such that an opening is produced in a plastic web which is disposed in the interior of the document, the security element being fitted into the opening. The security element is then fixed in the opening by cover foils which are applied at both sides. A procedure of that kind suffers on the one hand from the disadvantage that the operation of applying the security element gives rise to major difficulties and in particular the procedure requires lamination over the full surface areas of coaratively large regions of plastic foils. Inclusion of the security element between the two foils frequently results in a marked impairment in the level of brilliance and thus an adverse effect on the discernibility of the security element, in particular under poor lighting conditions. The known document can only be used with difficulty as a value-bearing paper, in particular banknotes, because it is fundamentally different in terms of its surface nature and other properties, from the properties of paper which are known and familiar in particular in the case of banknotes.

It is also already known from Australian banknotes for printing to be applied to the surface of transparent carriers in such a way that a given region is left window-like, that is to say transparent. In this case also however the advantages of paper have to be foregone. It is for example not possible to apply a watermark. In addition the tactile properties which are known to the citizen are different in comparison with paper (absence of the particular grippy feel). The tried and tested processing and treatment properties as well as the circulation properties of paper are also no longer enjoyed. Finally it is not possible in a pure printing process to produce specific security elements, for example diffraction structures.

It is also already known to use security threads as security elements in value-bearing documents, the arrangement being such that the thread or a corresponding strip is superficially exposed in a region-wise manner in order to be able to check additional security features which are preferably based on optical effects, on the thread or strip, for example printing patterns, diffraction structures etc. European patent specification No 0 229 645 describes the production of a security paper with an incorporated security element in the form of a thread or strip in such a way that two separate layers or plies of paper are formed, the layers of paper having regions of smaller thickness or openings therethrough. The two layers of paper are brought together and, during the operation of bringing them together, the strip which serves as the security element is introduced. In that respect the arrangement may also be such that the openings through the two layers of paper (on the top and underside respectively of the strip serving as the security element) coincide in aligned relationship so that the security element is exposed at the same location on the paper web on both sides thereof in order also to permit the security element to be viewed in the transillumination mode. In practice however it has been found that it was hitherto not possible to produce corresponding documents. In general terms on the contrary the arrangement was only so selected that the security thread or the security element was exposed alternately on the top side and the underside respectively. At any event a serious disadvantage of the known procedure is that, as the security threads have to be incorporated into the paper web, they may only be of comparatively small width in order not to destroy the cohesion of the paper in itself. In order however for the security threads to be of adequate strength in spite of their small width, it is necessary to use security threads of correspondingly large thickness, which can result in undesirable increases in the thickness of the value-bearing papers produced from the corresponding paper web; in that case, when the value-bearing papers are stacked—in spite of using the so-called wobble or offset procedure—those thickened portions would always be disposed in a relatively narrow region, which results in the sheets not lying properly flat and gives rise to problems in processing of the document.

OBJECTS OF THE PRESENT INVENTION

The object of the present invention is therefore that of proposing a value-bearing document with a window-like security element suitable for transillumination, which can be produced easily and without adversely affecting the discernibility of the security element, while the problems known in regard to the production of security papers with incorporated security thread are not to be expected in the production procedure. The invention however seeks to ensure that forgery of the security element by pure printing or color copying is impossible, but at the same time there is a large number of different possible design configurations for the security element.

SUMMARY OF THE INVENTION

In accordance with the invention, in a value-bearing document having at least one security element and at least one window-like through opening which is closed by means of a light-transmitting film, to attain that object, it is proposed that the opening is subsequently produced in the finished carrier and the finished carrier thereafter serves for production of the value-bearing document such as a bank note, check form or the like and is closed by means of an at least region-wise transparent cover foil which projects beyond the opening on all sides and which is fixed on a surface of the carrier over the full area thereof.

In accordance with the invention therefore the attempt is no longer made to incorporate a security element into the carrier. On the contrary the opening is deliberately subsequently produced in the carrier and then the opening is closed again by means of a cover foil which is transparent at least in a region-wise manner, wherein the fact that the cover foil is fixed on the surface of the carrier, over the full area thereof, means that detachment of the cover foil which possibly carries a security feature which is based for example on optical effects is practically impossible, without damaging the carrier. By virtue of the arrangement in accordance with the invention it is readily possible to use a cover foil of comparatively large length or width, which means that it is possible to operate with cover foils of small thickness. At the same time a procedure in accordance with the invention also affords the possibility of providing windows of relatively large dimensions, whereas only very small dimensions could be achieved with the known windows which were produced during the paper production process. As the windows can be large, even when there are additional security elements it is readily possible for a sufficiently large region of the cover foil to be kept completely transparent. In this case, when a copy is produced using a photocopier or any other reproduction apparatus, the background will be visible in the region of the window so that the color of the background appears at that point in the reproduction. In that way forgeries can generally be easily detected. Furthermore, the authenticity of the value-bearing document can also be easily detected by the user as the presence or absence of a transparent region in the value-bearing document can be readily detected even with the naked eye. The fact that the opening in the carrier is covered over by means of the cover foil affords on the one hand the advantage that the stability of the value-bearing document does not suffer, in spite of the presence of one or even more through openings.

On the other hand the use of a cover foil affords further possible configurations in regard to the security element. Variations in the security element are further possible by virtue of different shapes for the window-like opening or a variation in the positioning of the opening or the provision of a plurality of openings which are possibly of different configurations.

In order to permit easy stacking of value-bearing documents, in particular value-bearing papers such as for example banknotes and in order also to make it substantially more difficult to pull off the cover foil and in particular as far as possible to prevent the cover foil from being unintentionally detached, the cover foil is desirably arranged in a depression in the carrier surface, which depression includes the window-like opening, while it is particularly advantageous for the carrier to be compressed to form the depression. The compression operation simultaneously smooths the surface of the carrier, which can be advantageous in regard to certain security features. For example, when security features are applied to paper by a hot stamping process, the optical efficiency thereof is reduced by the comparatively rough surface of the paper, and that can be avoided by suitable smoothing of the surface of the paper, which serves as the carrier.

In accordance with the invention the opening can be easily produced by means of a punching or cutting operation, in which respect mention is to be made here of the usual punching processes and in particular laser cutting as a cutting process.

It is basically possible for the depression and the opening to be produced in separate working operations. In order to avoid special adjustment operations and to achieve good alignment of the opening in relation to the depression, the procedure involved is desirably such that the opening is produced jointly with the depression in one working operation, and that can be effected for example by using suitable tools, for example special stamping and punching rollers.

The operation of producing the depression and applying the cover foil is simplified when the cover foil extends transversely over the entire width or length of the value-bearing document, that is to say there is a depression from one edge to another. More specifically, in such a case the procedure involved is desirably such that the cover foil is applied by means of pressure to the carrier of the value-bearing document with the depression being formed at the same time, the cover foil preferably being laminated on to the carrier in a rolling process.

When using a lamination operation for applying the cover foil to the value-bearing document, it is possible to achieve a particularly desirable method of manufacture. More specifically, in one run through a suitable machine, firstly the window-like opening and possibly also a plurality of openings can be formed, and thereupon the cover foil is applied by a lamination procedure in a further step.

For further improving the safeguards against forgery, it is provided in accordance with the invention that, at least on one side of the carrier, the cover foil and at least the adjoining surface region of the value-bearing document are overprinted with an interconnected pattern. With such a configuration, any manipulation on the cover foil is immediately visible because it is readily possible to provide printing in which just very slight displacements are clearly apparent.

In order to facilitate overprinting of the cover foil, desirably the cover foil may carry a bonding or primer layer at least on its free side which is not fixed to the value-bearing document or the carrier forming same.

Further possible ways of improving the degree of safeguard against forgery of a value-bearing document are afforded if, in accordance with the invention, the cover foil is a lamination foil comprising a transparent carrier film and a decorative layer which adheres fixedly thereto, wherein the decorative layer which preferably includes at least one lacquer layer is also transparent at least in a portion of the opening. The decorative layer can be of specific graphic configurations using different per se known processes in order thereby to afford additional recognition options for an original value-bearing document. It is always important however for the decorative layer to be at least partially transparent in the region of the opening.

It may further be desirable for the cover foil to be provided with at least one particular security feature which is based preferably on optical effects, and for at least a portion of the surface region of the opening to be left transparent, while advantageously at least one security feature is formed by a thin-layer arrangement and/or diffraction structure having an optical diffraction and/or refraction effect. Besides such diffraction structures or thin-layer arrangements as the security feature, the cover foil may also include for example reflecting surfaces, special prints, for example in the form of microscript etc. In that respect it is desirable if at least one of the security features is arranged in the surface region of the opening because that may then involve for example such a security feature which can be checked in respect of authenticity only in the transillumination mode, it being precisely transillumination processes that afford advantages when using automatic testing equipment.

When using a lamination foil as the cover foil, having a decorative layer and at least one diffraction structure as the security feature, the decorative layer is desirably such that it has—starting from the carrier film—a base lacquer layer which is provided at least in a region-wise manner at its surface remote from the carrier film with the diffraction structure serving as the security feature, at least in the a region of the diffraction structure a reflecting layer, and at least in the region of the opening a transparent protective lacquer layer. In that respect the structure of the decorative layer in the lamination foil in accordance with the invention is in principle the same as the decorative layer structure which is known per se from hot stamping foils for security purposes with a diffraction structure, and as is to be found for example in EP 0 559 069 A1. In addition, for applying the various lacquer layers, for introducing the diffraction structure and for producing the metallization which is possibly only partial, it is also possible to use the processes which are known in principle in connection with the production of hot stamping foils, and for that reason those processes will not be discussed in greater detail here. It will be appreciated that it would also be possible for a diffraction structure to be introduced directly into the carrier foil, that is to say, it would be possible to omit a separate base lacquer layer if a suitable carrier foil is used.

If, as the invention further provides, the cover foil is fixed on the carrier in such a way that its decorative layer faces towards the surface of the carrier, that gives on the one hand the advantage that the surface of the cover foil, which carries the decorative layer, is arranged in a virtually recessed or depressed relationship and thus protected to a certain extent from mechanical loadings. Furthermore, under some circumstances, it is possible to omit a special adhesive layer for fixing the cover foil on the value-bearing document, namely when the decorative layer and more specifically at least the transparent protective lacquer layer thereof already has sufficiently adhesive properties.

A further possibility in accordance with the invention provides that the decorative layer carries a layer of a hardenable adhesive, on the side of the decorative layer which is opposite the carrier film, in which respect it is possible to use for example reaction adhesives which completely react and thus harden only when subjected to the effect of appropriate heat or radiation, for example IR- or UV-radiation. The use of adhesives of that kind has the advantage that detachment of the cover foil when the adhesive has hardened is impossible without damage to the value-bearing document itself.

Finally it may be advantageous if the carrier has an application of adhesive in the region which serves for fixing the cover foil, in which case it is sufficient under some circumstances to provide only that application of adhesive on the carrier, although it may also be desirable if, in spite of the application of adhesive on the carrier, the cover foil is additionally provided with a corresponding adhesive layer. If it is only the carrier that is provided with the application of adhesive, that gives the advantage that it is possible to avoid adhesive possibly being spread in the region of the opening.

Figure 2:
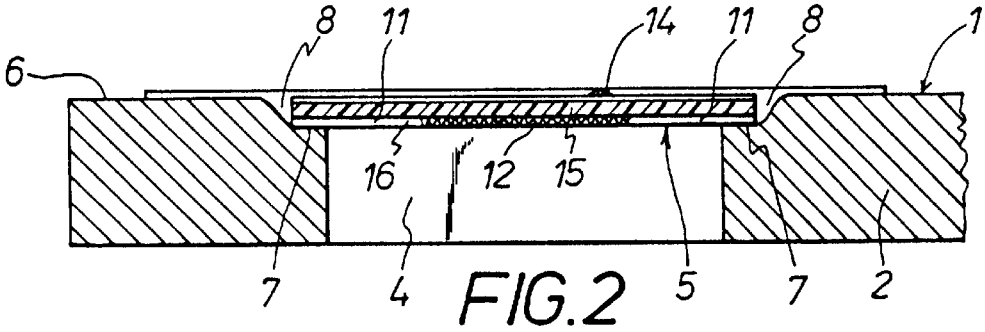
Figure 3:
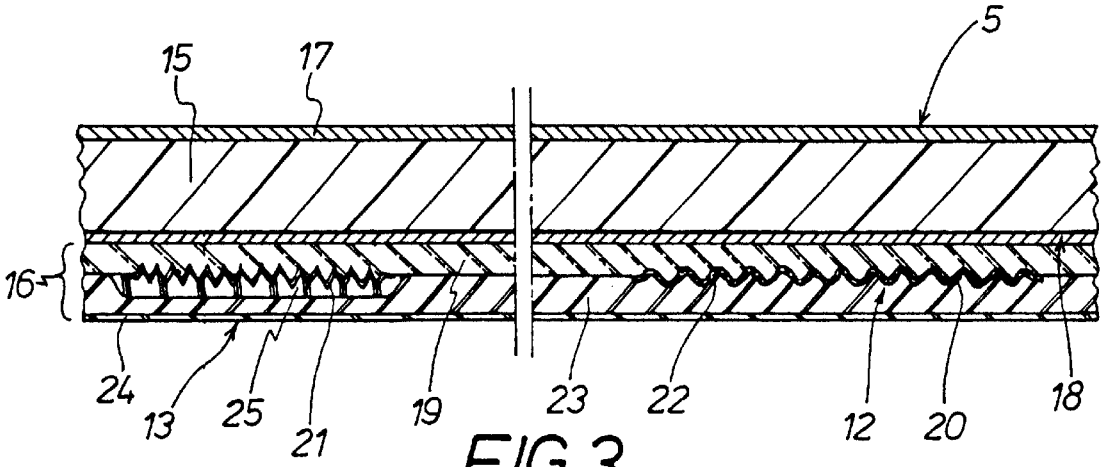

Further features, details and advantages of the invention will be apparent from the following description of a value-bearing paper designed in accordance with the invention, with reference to the drawing in which:

FIG. 1 is a diagrammatic view of a value-bearing paper of the configuration according to the invention, FIG. 2 is a partial cross-section through the value-bearing paper in FIG. 1 taken along line II—II in FIG. 1, and FIG. 3 is a view in section taken along line III—III in FIG. 1 through an embodiment of a cover foil, the paper carrier of the value-bearing paper having been omitted for the sake of enhanced clarity.

DETAILED DESCRIPTION OF THE PRESENT INVENTION

The value-bearing paper 1 which is diagrammatically shown in FIG. 1 can be used in respect of its fundamental configuration (in accordance with the invention) for all possible kinds of value-bearing printed matters, for example banknotes, cheques, travellers' cheques, shares etc, in which respect more detailed features are not shown in the drawing and, besides the security elements according to the invention, security measures which are otherwise also possible are not discussed in greater detail. Furthermore, a fundamentally corresponding structure is also intended for other value-bearing documents, for example credit cards, identity cards or the like.

The value-bearing paper shown in FIG. 1 comprises a paper carrier 2 which can be provided for example in the manner known from banknotes with a watermark, with special imprints thereon and other security elements, like one diagrammatically indicated for example at 3. The security element 3 can be for example in the form of a special microprint. It may however also be a specific embossing or stamping, a reflecting embossing or stamping etc. Normally, in production of the value-bearing paper 1, the paper carrier 2 is part of a web of paper or a sheet of paper from which the value-bearing paper 1 is cut after production. In the case of value-bearing documents other than value-bearing papers, other suitable carrier is a plastic card or foil.

As shown in FIGS. 1 and 2, the carrier 2 has at least one window-like through opening 4 which is closed by means of a cover foil 5, wherein the cover foil 5 is fixed over the full area on the one surface 6 of the carrier 2, preferably by adhesive, so that it projects at all sides beyond the window-like opening 4, as can be seen from FIGS. 1 and 2, so that the cover foil 5 adheres firmly to the surface 6 of the carrier 2 around the opening 4 in the regions 7 (FIG. 2).

It can be seen in particular from FIG. 2 that the cover foil is arranged in a depression 8 in the surface 6 of the carrier 2 so that, in the finished value-bearing paper 1, the cover foil does not cause a substantial increase in the thickness of the value-bearing document, and that is important in particular when a multiplicity of value-bearing documents is to be stacked. The security threads which were known hitherto in relation to value-bearing papers are only relatively narrow and must therefore be comparatively thick for mechanical reasons. In that case however they project far above the surface of the value-bearing paper and, when value-bearing documents are stacked, those threads, in the region thereof, result in an undesirable increase in the thickness of the stacks, which possibly makes production and automatic handling of the value-bearing papers more difficult.

The depression 8 is produced by the paper carrier 2 being compressed in the region of the depression 8. That can be effected in a simple manner simultaneously with the operation of applying the cover foil 5 to the surface 6 of the carrier 2, more specifically by a procedure whereby, when the cover foil 5 is applied to the surface 6 of the carrier 2, a correspondingly high pressure is applied, which results in permanent compression of the carrier 2.

As FIG. 1 shows the depression 8 for the cover foil 5 extends over the entire width of the carrier 2 from its lower eta 9 to the top edge 10. That configuration affords the advantage that both the operation of applying the cover foil 5 and also the operation of forming the depression 8 can be effected in a rolling process by means of suitable rolls or rollers, which affords the possibility of providing the value-bearing paper 1 with the cover foil 5 in a continuous process, wherein, in a step preceding the operation of applying the cover foil 5, the window-like opening can be produced by punching, which in fact can also be performed in a rolling process. In that respect, if the tool is of a suitable configuration, the punching operation can be combined with the compression operation, in one working procedure.

FIG. 1 shows that the cover foil 5 is transparent only in a portion of the window-like opening 4, namely the outer region 11, while provided in the inner region of the opening 4 is an additional security feature 12 which is based for example on optical effects, for example in the form of a diffraction structure which is operative in a transmission mode. However, the additional security element 12 in the window-like opening 4 can not only be formed by a diffraction structure having an optical-diffraction and/or optical-refraction effect, for example a hologram, a pixelgram etc. It would also be possible to choose as the additional security element 12 for example a reflecting surface, a particular microprint, a thin-layer arrangement or some other configuration which can only be imitated with difficulty.

In addition, as shown in FIG. 1, outside the region corresponding to the window-like opening the cover foil may be provided with at least one additional security feature 13 which is based for example on optical effects, which security feature 13 can also be of the most widely varying kinds and natures in dependence on the material of the cover foil, any coating thereon etc.

In accordance with the invention undesired detachment of the cover foil 5 from the surface 6 of the carrier 2 is made more difficult by virtue of the fact that the cover foil 5 and the adjoining regions of the surface 6 of the carrier 2 are overprinted with an interconnected pattern 14. That operation of printing the pattern 14 can also be effected in the continuous process already mentioned above, in a process step which occurs downstream of the operation of applying the cover foil 5.

It will be seen from the foregoing that a value-bearing document, for example a value-bearing paper 1 in accordance with the invention, affords a large number of further options in regard to the provision of security features, in comparison with the previously known value-bearing documents, but in that respect it is however always necessary to ensure that the cover foil 5 is transparent at least in a region-wise manner, in the region of the at least one window-like opening 4—it will be appreciated that a plurality of openings could also be provided—because it is only then that it is possible to carry out a checking operation using the naked eye and it is only in such a case that an optical falsification effect occurs, upon an attempt at reproduction by means of color copying or printing, in the transparent region within the opening 4. That falsification effect occurs in fact totally irrespective of which color is selected for the background in the copying operation, because the corresponding region is not transparent in any case.

FIG. 3 diagrammatically shows a lamination foil as can be used as the cover foil 5 for the value-bearing paper 1 in FIGS. 1 and 2.

That cover foil 5 in FIG. 3 comprises a transparent carrier film 15. On its surface which is remote from the decorative layer 16, it is provided with a thin bonding or primer layer 17 which is intended to ensure that the pattern 14 which is applied by printing adheres firmly to the carrier film 15.

The opposite surface of the carrier film 15 is also provided with a bonding or primer layer 18 which is intended to ensure adequate adhesion of the decorative layer 16 on the carrier film 15.

In the embodiment shown in FIG. 3 the decorative layer 16—corresponding to the view shown in FIG. 1—is provided with different security features 12, 13, both cases involving diffraction structures in accordance with the foregoing description.

For that purpose the decorative layer 16 has a thermoplastically deformable base lacquer layer 19. Different diffraction structures 20 and 21 respectively are provided in that base lacquer layer 19 in the regions corresponding to the security features 12, 13, in which case the diffraction structures 20, 21 are produced by suitable embossing of the thermoplastically deformable base lacquer layer 19 after the application thereof to the carrier film 15.

It will be appreciated that the diffraction structures 20, 21 are only visible at the cover foil 5 when the layers enclosing the diffraction structures 20, 21 have suitably different optical properties. For example, in the case of the diffraction structure 20 of the security feature 12, that is achieved in that a reflecting metal coating 22 is provided in the region of the diffraction structure 20; the metal layer 22 may be for example an aluminium layer which is produced by vapor deposition in a vacuum or a layer, applied in a suitable manner, of another material which is known to be suitable.

Another possible way of rendering the diffraction structures 20, 21 visible provides that a suitable dielectric, for example $TiO_2$ or TnS is applied in the region of the diffraction structures 20, 21.

Then, in relation to the cover foil 5, the diffraction structure is covered over by means of a transparent protective lacquer layer 23 which in turn can carry a bonding or primer layer 24, at least in the region of the opening 4, in which respect the bonding or primer layer 24 has in particular the purpose of promoting adhesion of the cover foil 5 to the surface 6 of the carrier 2. In addition however it may also favour a printing operation which is possibly to be subsequently effected—when dealing with correspondingly thin value-bearing documents or in the case of large openings—on the side of the cover foil, which is remote from the surface 6 of the carrier 2, in the region of the opening or openings 4.

While the protective lacquer layer 23 is usually colorless—to facilitate identification of the security element—it can certainly be provided that, besides its diffraction effect, the second security feature 13 is distinguished by a particular coloring. In the case of the foil shown in FIG. 3 for example that is achieved by the diffraction structure 21 of the security feature 13 being covered with a transparent but colored lacquer layer 25 prior to the application of the protective lacquer layer 23.

More specifically a cover foil 5 as shown in FIG. 3 could be of the following structure:

Bonding or Primer Layers 17, 18 and 24:

These layers are of a thickness of 0.2 to 2, preferably 0.5 to 1.2 μm. The bonding or primer layers 17 and 24 can possibly be omitted, more especially in particular when subsequent overprinting of the cover foil is not envisaged.

The bonding or primer layers are applied by a per se known printing process, in which respect they may be of the following composition:

| | Parts by weight |
|---|---|
| Methyl ethyl ketone | 400 |
| Toluene | 250 |
| Cyclohexanone | 50 |
| Hydroxyl group-bearing vinyl chloride vinyl acetate terpolymer (Tg = 79° C., MW about 23,000) | 210 |
| Vinyl chloride vinyl acetate copolymer (MW about 4,000) | 90 |

Carrier Film 15:

This involves a suitable, optically clear, that is to say perfectly transparent, film which should be as thin as possible in order not to stick up on the value-bearing paper, but on the other hand it must afford adequate strength. Polyester (PET) or polycarbonate (PC) films of a thickness of between 6 and 12 μm have been found to be suitable.

Thermoplastically Deformable Base Lacquer Layer 19:

This layer is of a thickness of usually 0.8 to 2 μm, the thickness of the layer depending on the nature of the structure to be applied thereto, The base lacquer layer 19 is also applied by a printing process and can be for example of the following composition:

| | Parts by weight |
|---|---|
| Ethyl acetate | 350 |
| Toluene | 200 |
| Butyl acetate | 130 |
| Polymethyl methacrylate (softening point about 170° C.) | 270 |
| Styrene copolymer (softening point about 100° C.) | 50 |

Diffraction Structures 20, 21:

These structures are known per se and are embossed into the base lacquer layer 19 by means of suitable dies. The metallization 22 comprises for example aluminium, chromium, gold or silver, applied in a vacuum; depending on the material used pulverization can be effected by suitable processes, for example by vaporization, sputtering etc. Instead of the metal layer it is also possible to apply a suitable dielectric, for example $TiO_2$ or ZnS. Desirably, metallization is applied over the entire, suitably shaped surface of the thermoplastic base lacquer layer 19 and then partially removed using a known process. There are different processes in that respect, in which case in particular those processes are used in which, prior to the application of the metal layer, the structured surface of the thermoplastic base lacquer layer 19 is provided with a detachable layer in the unstructured regions, for example by printing in suitable register relationship. After the metallization operation that detachable layer is then removed again and thus the metallization is removed again in the region of the detachable layer. The thickness of the metallization or the dielectric layer is for example 60 to 20 Å.

Transparent Protective Lacquer Layer 23:

This layer is of a thickness of 1 to 5 μm, preferably 2 to 3 μm, in which respect the thickness can be less in the regions where the additional lacquer layer 25 is provided than in the regions without an additional lacquer layer of that kind. Moreover the thickness of the protective lacquer layer 23 depends on the respective mechanical requirements; in that respect, they are normally not excessively high because on the one hand the size of the opening 4 is restricted and on the other hand the cover foil 5 is preferably applied to the surface 6 of the carrier 2 in such a way that the decorative layer 16 faces towards the surface 6 of the carrier 2 so that the heavy mechanical loading occurs on the side of the carrier film 15.

The transparent protective lacquer layer can be for example of the following composition:

| | Parts by weight |
|---|---|
| Methyl ethyl ketone | 300 |
| Ethyl acetate | 170 |
| Cyclohexanone | 100 |
| Hydrofunctional acrylate (60% in xylene/EPA, OH-number 140) | 200 |
| Cellulose nitrate (low-viscosity, 65% in alcohol) | 80 |
| Aromatic isocyanate (50% in ethyl acetate, NCO-content 8%) | 150 |

The protective lacquer layer 23 and possibly the additional lacquer layer 25 are normally applied by a printing process, in which case the additional lacquer layer 25 is to be applied by printing prior to the protective lacquer layer 23. In regard to the composition of the additional transparent lacquer layer 25, it is to be noted that this can be of substantially the same composition as the protective lacquer layer 23, but additionally contains a transparent coloring agent.

In production of a value-bearing document, for example a value-bearing paper 1 in accordance with the invention therefore firstly the cover foil 5 is produced, for example in a manner which is basically known from the production of hot stamping foils, although the difference between the cover foil 5 and a hot stamping foil is that, in the case of the cover foil 5, care is taken to ensure that the decorative layer 16 adheres firmly to the carrier film 15 while the essence of a hot stamping foil is in fact precisely to be seen in the fact that the decorative layer can be easily detached from the carrier film.

The cover foil is then applied to the carrier 2 of the value-bearing document, for example a value-bearing paper 1, preferably in a continuous rolling procedure, in which case the window-like opening 4 is desirably produced in a first working operation, for example by punching. Subsequently or at the same time the carrier 2 is compressed to produce the depression 8, which can be effected for example by means of rollers, using suitably high pressures. Now, the cover foil 5 is applied to the surface 6 of the carrier 2, by rolling. Fixing of the cover foil 5 on the carrier 2 can be effected by the protective lacquer layer 23 or the bonding or primer layer 24 of the decorative layer 16 of the cover foil 5 having suitable adhesive properties or by the decorative layer 16 of the cover foil 5 additionally being provided with a hardenable adhesive layer (not shown). A further option is that, prior to the application of the cover foil 5, the surface 6 of the carrier 2 is provided in the region of the depression 8 with an application of adhesive, by means of which the cover foil 5 is then fixed to the carrier 2. Which of the two measures is adopted depends on the nature or composition of the carrier 2, the decorative layer 16 of the cover foil 5 and the respective purpose of use, in which respect it is also conceivable for adhesive to be provided both on the cover foil 5 and also on the carrier 2.

After application of the cover foil 5 the surface 6 and possibly also the underside of the carrier 2 can then also be overprinted with the interconnected pattern 14 by means of a conventional printing process for further enhancing the security aspect. Finally when producing value-bearing papers the individual value-bearing papers are cut out of the paper combine (web, sheets) forming a plurality of carriers 2.

The described embodiment of the value-bearing document involves a value-bearing paper. However the concept of the invention can also be applied in the same manner in relation to value-bearing documents consisting of materials other than paper, for example credit cards, identity cards etc.

What is claimed is:

1. A value-bearing document, which comprises:

a carrier member denominated with a value and having a planar surface and a depressed surface, said depressed surface including an opening formed in said carrier member, said planar surface including a security element; and a cover foil transparent at least region-wise mounted on said depressed surface and covering said opening.

2. The value-bearing document as defined in claim 1 wherein said depressed surface is formed by compression.

3. The value-bearing document as defined in claim 1 wherein said opening is formed by an operation selective from the group consisting of a punching and cutting operation.

4. The value-bearing document as defined in claim 1 wherein said opening and depressed surface surrounding said opening are produced in one working operation.

5. The value-bearing document as defined in claim 1 wherein said depressed surface extends transversely over a width or length of said carrier member.

6. The value-bearing document as defined in claim 1 or 5 wherein said cover foil is applied by pressure to said member simultaneously with formation of said depressed surface.

7. The value-bearing document as defined in claim 1 wherein said cover foil is lamminated to said depressed surface of said carrier member in a rolling process.

8. The value-bearing document as defined in claim 1 wherein said cover foil and a portion of said planar surface of said carrier member adjoining said cover foil are covered by an interconnecting pattern.

9. The value-bearing document as defined in claim 1 wherein said cover foil includes a bonding layer on an upper side thereof.

10. The value-bearing document as defined in claim 1 wherein said cover foil is a lamination foil comprised of a transparent carrier layer and a decorative layer.

11. The value-bearing document as defined in claim 2 wherein said decorative layer includes a lacquer layer.

12. The value-bearing document as defined in claim 1 wherein said cover foil is provided with a security feature.

13. The value-bearing document as defined in claim 12 wherein said security feature provides an optical effect.

14. The value-bearing document as defined in claim 12 wherein said security feature provided on said cover foil is proximate said opening in said depressed surface of said carrier member.

15. The value-bearing document as defined in claim 12 wherein said security feature is formed by a thin layer arrangement and/or diffraction structure having an optical-diffraction and/or optical-refraction effect.

16. The value-bearing document as defined in claim 10 wherein, starting with said transparent carrier layer, said decorative layer includes a base lacquer layer, a diffraction structure applied region-wise to said base lacquer layer, a reflecting layer applied to said diffraction structure and a transparent protective lacquer layer.

17. The value-bearing document as defined in claim 10 wherein said decorative layer faces said depressed surface of said carrier member.

18. The value-bearing document as defined in claim 10 wherein said decorative layer includes a hardenable adhesive layer on a side opposite said transparent carrier layer.

19. The value-bearing document as defined in claim 1 wherein said depressed surface is provided with an adhesive for mounting said cover foil.

* * * * *

UNITED STATES PATENT AND TRADEMARK OFFICE

CERTIFICATE OF CORRECTION

PATENT NO. : 6,428,051 B1 
DATED : August 6, 2002
INVENTOR(S) : Herrmann et al.

It is certified that error appears in the above-identified patent and that said Letters Patent is hereby corrected as shown below:

Column 7,
Line 11, now reads "eta 9 to the top edge 10. That configuration affords the" should read -- "edge 9 to the top edge 10. That configuration affords the" --

Signed and Sealed this

Eleventh Day of February, 2003

JAMES E. ROGAN
*Director of the United States Patent and Trademark Office*